United States Patent [19]

Miyake

[11] Patent Number: 4,558,258

[45] Date of Patent: Dec. 10, 1985

[54] KLYSTRON UNIT

[75] Inventor: Setsuo Miyake, Fujisawa, Japan

[73] Assignee: Tokyo Shibaura Denki Kabushiki Kaisha, Kawasaki, Japan

[21] Appl. No.: 488,609

[22] Filed: Apr. 25, 1983

[30] Foreign Application Priority Data

Apr. 26, 1982 [JP] Japan ..... 57-68592

[51] Int. Cl.[4] ..... H01J 25/10

[52] U.S. Cl. ..... 315/5.39; 315/5.35; 315/5.43; 315/5.51

[58] Field of Search ..... 315/5.39, 5.35, 5.43, 315/5.51

[56] References Cited

U.S. PATENT DOCUMENTS

| | | | |
|---|---|---|---|
| 3,076,116 | 1/1963 | Drieschman et al. | 315/5.35 |
| 3,297,907 | 1/1967 | La Rue et al. | 315/5.35 |
| 3,366,904 | 1/1968 | Schmidt | 315/5.35 |
| 3,394,282 | 7/1968 | Schmidt | 315/5.35 |
| 3,521,117 | 7/1970 | Schmidt | 315/5.51 |
| 3,725,721 | 4/1973 | Levin | 315/5.43 |
| 3,819,977 | 6/1974 | Kageyama | 315/5.43 |
| 4,099,133 | 7/1978 | Heppinstall | 315/5.35 |

*Primary Examiner*—Saxfield Chatmon
*Attorney, Agent, or Firm*—Cushman, Darby and Cushman

[57] ABSTRACT

A klystron unit not subject to variation and spurious components in the output signal. An electron gun generates an electron beam toward a collector. An input resonator is located in the vicinity of the electron gun. An output resonator is located in the vicinity of the collector. At least one intermediate resonator is disposed between the input and output resonators. Drift tubes are disposed along the electron beam path and couple the resonators together allowing for a drift gap in each resonance cavity. Means are provided for generating magnetic flux along the electron beam path. Means are also provided to distribute the magnetic flux density so that it is at a maximum point within a predetermined area and gradually decreases toward the collector. The predetermined area lies between the drift gap in the output resonator and a point which is at most 3/5ths of the distance from the output resonance cavity drift gap to the drift gap of an intermediate resonance cavity which is adjacent to the output resonance cavity.

21 Claims, 19 Drawing Figures

KLYSTRON UNIT

BACKGROUND OF THE INVENTION

The present invention relates to a klystron unit and, more particularly, to an improvement in a multicavity klystron unit.

In a klystron unit as known, an electron gun which generates an electron beam and a collector section for collecting the electron beam are arranged oppositely to each other on a common axis. An input resonance cavity, one or more intermediate resonance cavities and an output cavity are located along a beam path between the gun and the collector section. Drift tubes for defining the beam path which the beam passes are provided between these cavities, and a tube assembly is formed of these drift tubes and the resonators. This assembly is placed in an electromagnet coil assembly and the beam is focused by a magnetic field produced by the coil assembly.

When a signal of a continuous wave or a low modulation frequency is amplitude-modulated in such a multicavity klystron unit, the klystron is operated in a sufficiently stable and high input-to-output conversion efficiency. When the klystron, however, amplifies a pulse signal or a pulsating signal such as a synchronizing signal of a television broadcasting radio wave, an output signal is frequently vibrated at the frequency around several MHz as shown by reference characters A1 and A2 in FIG. 1, or the output level is unstably varied as shown by reference characters B1 and B2 in FIG. 2. It is confirmed that this phenomenon occurs intermittently at a level higher than the output level of approx. 60% of the saturated output. When the standing wave ratio of an input signal is deteriorated, such a phenomenon occurs even at the output level less than 50% of the saturated output. In order to prevent the occurrence of this undesirable phenomenon, it is necessary to operate the klystron in the state that the input-to-output conversion efficiency is reduced to less than 50%. A method of detuning the tuning frequency of an intermediate cavity disposed in the nearest position to the output cavity to sufficiently high frequency sufficiently higher than the operating frequency and thereby reducing the velocity distribution of an electron beam which flows into the gap of the output cavity is disclosed as one method of preventing such a phenomenon in Japanese Patent Laid-Open No. 149,471/1977. According to this method, the reverse flow of the electrons from the vicinity of the output cavity toward the gun can be suppressed, thereby obtaining a klystron which can provide approx. 55% of input-to-output conversion efficiency.

This is one remedy to improve the above drawback, but since the intermediate cavity which is disposed at the nearest position to the output cavity is designed to be detuned to a frequency much higher than the tuning frequency which can originally provide the maximum efficiency, the efficiency is not yet sufficiently improved and this klystron is further required to be improved.

SUMMARY OF THE INVENTION

It is an object of the present invention to provide a klystron unit which can operate stably in sufficiently large input-to-output conversion efficiency without the mixture of suprious components in an output signal or variation of the output level.

According to an aspect of the present invention, there is provided a klystron unit comprising: an electron gun for generating an electron beam; a collector section for collecting the electron beam generated from said gun; an input resonator located along the beam path in the vicinity of said gun, for defining an input resonance cavity and velocity-modulating the electron beam in response to an input signal; an output resonator for defining an output resonance cavity located along the beam path in the vicinity of the collector section, from which an output signal is picked up; at least one intermediate resonator located along the electron beam path between the input and output resonators for defining at least one intermediate resonance cavity for velocity-modulating the electron beam; drift tubes disposed along the electron beam path for coupling the resonators to each other and defining a drift gap in each resonance cavity; means for focusing the electron beam by forming a magnetic flux along the electron beam path; and means for diverging the magnetic flux from a position which is within a predetermined region extending from the center of the drift gap within the output resonator to the intermediate resonator in the drift tube.

DETAILED DESCRIPTION OF THE PREFERRED EMBODIMENTS

Figure 5:
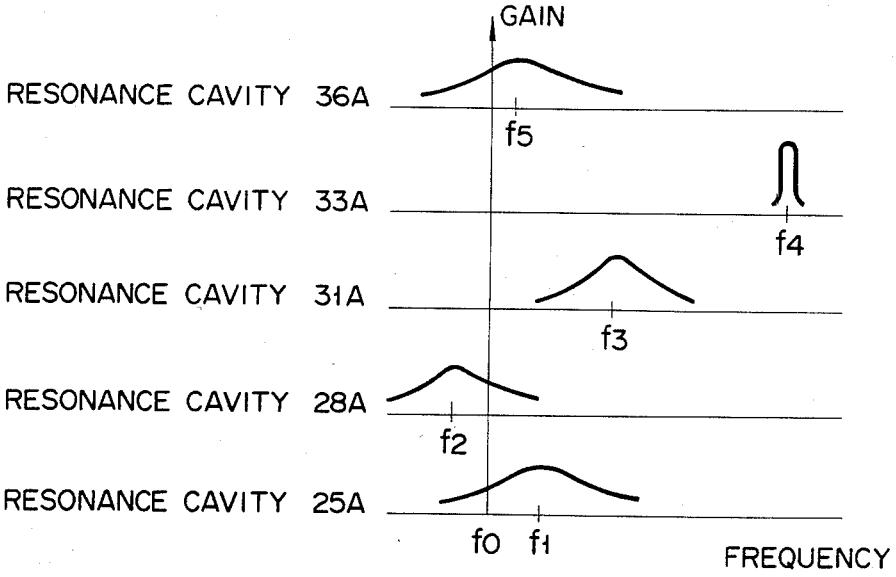
FIG. 5 is a graphic representation showing the relationship of the tuning frequencies of the resonance cavities in the klystron unit in FIG. 3.
Figure 6:
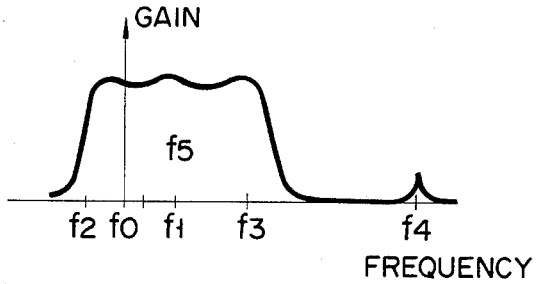
FIG. 6 is a graphic representation showing the band characteristics with the cavity tuning frequency shown in FIG. 5.
Figure 3:
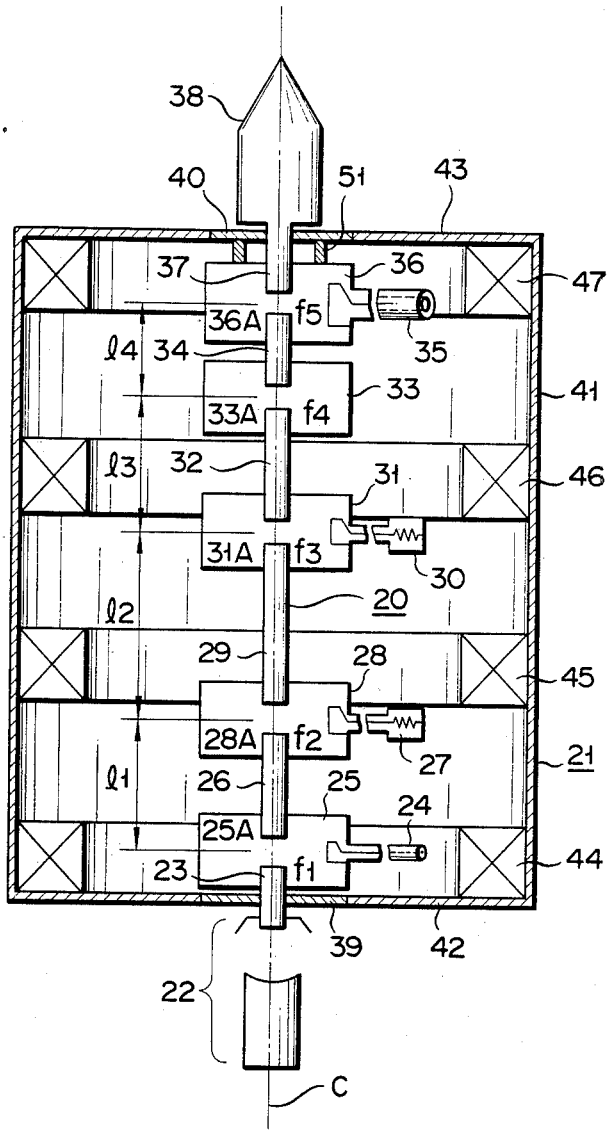
FIG. 3 is a sectional view schematically showing a klystron unit according to one embodiment of the present invention.
Figure 4:
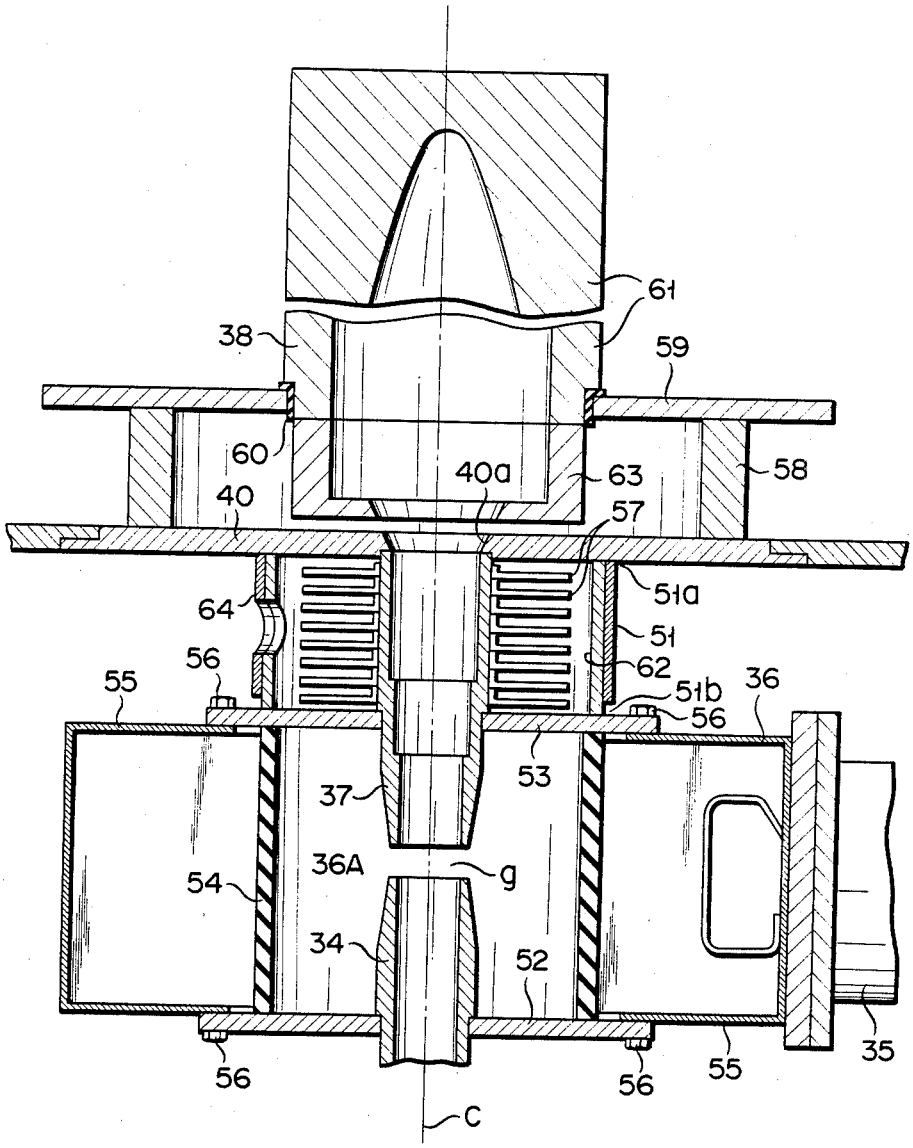
FIG. 4 is a sectional view partly enlarged of the klystron unit shown in FIG. 3.

FIGS. 3 and 4 schematically show a multicavity klystron unit used for a UHF television broadcasting power amplifying system according to one embodiment of the present invention. In this multicavity klystron unit, a tube assembly 20 is disposed in a magnetic coil assembly 21 for focusing an electron beam passing in the assembly 20. In the assembly 20, an electron gun section 22 for generating the beam and a collector section 38 for collecting the beam are disposed along a tube axis C of the assembly 20. Between the sections 22 and 38 are arranged an input resonator 25 connected to an input coaxial line 24 for defining an input resonance cavity 25A therein, a first intermediate resonator 28 connected to a dummy load 27 for defining a first intermediate resonance cavity 28A, a second intermediate resonator 31 connected to a dummy load 30 for defining a second intermediate resonance cavity 31A, a third intermediate resonator 33 not connected to the dummy load for defining a third intermediate resonance cavity 33A with high Q factor, and an output resonance 36 connected to an output coaxial line 35 for defining an output resonance cavity 36A. A first drift tube 23 and a second drift tube 26 are coupled to the resonator 25, the second and third drift tubes 26 and 29 are coupled to the resonator 28, and the third and fourth drift tubes 29 and 32 are coupled to the resonator 31. Further, fourth and fifth drift tubes 32 and 34 are coupled to the resonator 33, fifth and sixth drift tubes 34 and 37 are coupled to the resonator 36, and sixth drift tube 37 is coupled to the collector section 38. The openings of the respective tubes 23, 26, 29, 32, 34 and 37 are disposed oppositely to the openings of the other tubes similarly coupled to the resonators in the resonators coupled to the respective tubes, and an interaction gap of a predetermined length, namely, approx. 10 mm is defined between both the openings. As shown in FIG. 3, distances or drift lengths l1, l2, l3 and l4 between the centers of the gaps are so defined that the distance l2 is longest to obtain high efficiency and the distances l1, l3 and l4 are defined to become shorter in this sequence. Similarly, in order to obtain high efficiency, high gain and wide frequency band characteristics, the tuning frequencies of the respective input, first, second and third intermediate and output resonance cavities 25A, 28A, 31A, 33A and 36A are defined as f1, f2, f3, f4 and f5 and are defined in a relationship detuned from the central frequency f0 as shown in FIG. 5. The tuning frequencies f2 and f3 of the respective second and third resonance cavities 28A and 31A may be substituted for each other in the relationship in FIG. 5. The Q factors of the respective cavities are selected so that the total frequency band characteristics of the combined frequency characteristics in FIG. 5 becomes a predetermined band width as shown in FIG. 6.

The tube assembly 20 has disk-shaped pole plates 39 and 40 formed of ferromagnetic materials which are respectively disposed between the electron gun section 22 and the input resonator 25, and between the output resonator 36 and the collector section 38, the tubes 23 and 37 are correspondingly inserted into the holes of the pole plate 39 and 40, respectively, and the pole plates 39 and 40 are fixed to the drift tubes 23 and 37, respectively. Upper and lower end plates 42 and 43 of the yoke 41 of the magnetic coil assembly 21 are magnetically coupled to these pieces. Four electromagnetic coils 44, 45, 46 and 47 are disposed at a predetermined interval coaxially with the axis C of the tube assembly 20 in the yoke 41, and the magnetic flux is thereby formed in parallel with the axis C, namely, the electron beam path.

In one embodiment of the present invention, the multicavity klystron unit has, as shown in FIGS. 3 and 4, a cylindrical magnetic member 51 for diverging the magnetic flux which is located between the output resonator 36 and the pole plate 40 provided in the vicinity of the collector section 38. This member 51 is disposed coaxially with the axis C and coaxially around the tube 37. More concretely, the member 51, the output resonator 36 and the collector section 38 are arranged as shown in FIG. 4. More particularly, a copper end wall 52 is hermetically sealed at the drift tube 34, and an end wall 53 is hermetically sealed at the drift tube 37 oppositely to the wall 52. A cylindrical member 54 which is formed of a cylindrical ceramic dielectric material is hermetically sealed between a pair of disk-like end walls 52 and 53. A metal box 55 outside the member 54 is fixed with screws 56 to the end walls 52, 53. The output resonator 36 is formed of these end walls 52, 53 and box 55, and the output resonance cavity 36A is defined therein. The tube 37 is formed so that the bore becomes stepwisely larger toward the collector section 38, is soldered to the pole plate 40, and radiator fins 57 are fixed to the outer periphery of the tube 37. A copper collector electrode 61 is hermetically bonded through a stainless steel supporting ring 58, a metal disk 59 and an insulating ceramic spacer 60 to the plate 40, thereby forming the collector section 38. The radiator fins 57 provided between the wall 53 and the plate 40 are contained in a reinforcing cylinder 62 formed of a nonmagnetic material having large mechanical strength such as a stainless steel, and the cylinder 62 of the same diameter as member 54 is soldered to the wall 53 and the piece 40 coaxially to the member 54 of ceramic dielectric material. A copper cylinder 63 is connected as a collector extending part to the lower end of the electrode 61. The cylinder 62 is fitted into the member 51, one opening end **51*a* of the member 51 is magnetically connected intimately to the inner surface of the pole plate 40, and the other opening end 51*b* is extended toward the output resonator 36 along the tube 37, and is disposed in the vicinity of the wall 53. A plurality of holes 64 for introducing and exhausting cooling air at the radiator fins 57 are formed along the circumference at the cylinders 62 and the member 51**.

Figure 7:
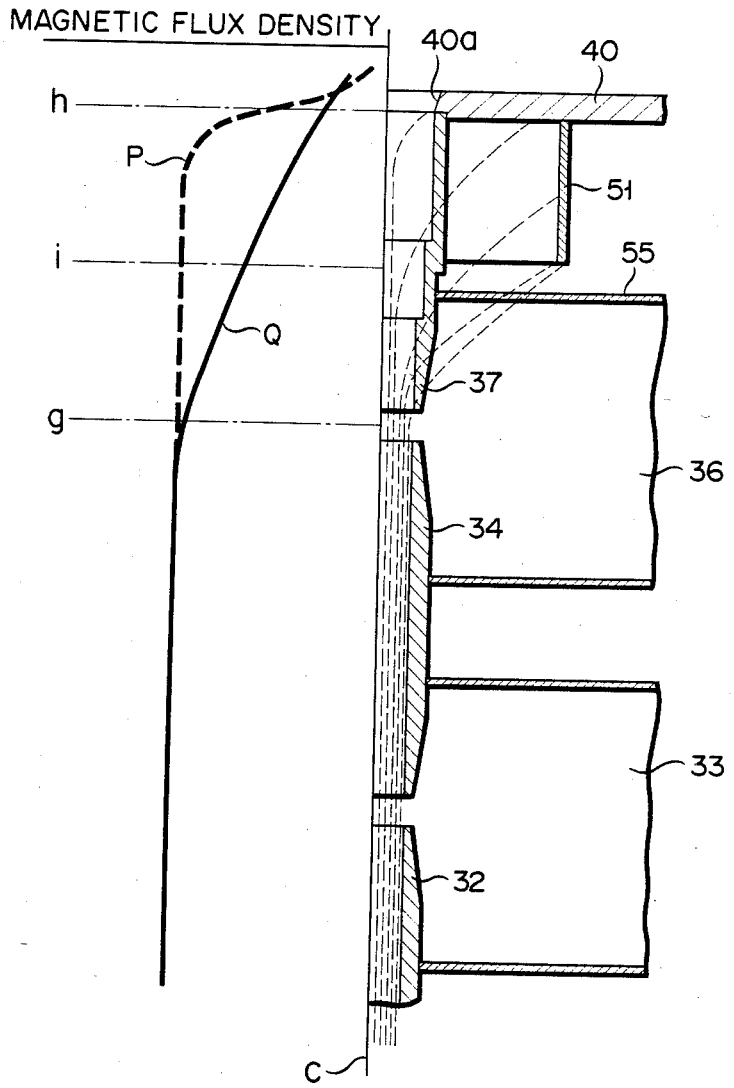
FIG. 7 is a view showing the relationship between the magnetic flux density in the klystron unit in FIG. 4 and the structure of the klystron unit.

The operation of the embodiment of the klystron unit will now be described. In the klystron unit having no cylindrical magnetic member 51, regarding a magnetic field distribution formed by the magnetic coil assembly, lines of magnetic force are substantially parallel to each other between the upper and lower plates 39 and 40, and the magnetic flux density on the electron beam and hence on the tube axis becomes the distribution as shown by a curve P of broken lines in FIG. 7. In other words, the distribution is substantially uniform in the vicinity of the gap g in the output cavity to the vicinity of the hole **40*a* of the pole plate 40, from which the magnetic flux density is abruptly decreased. On the other hand, in the klystron unit having the cylindrical magnetic member 51 provided at the outer periphery of the tube according to an embodiment of the present invention, part of the parallel lines of magnetic force passing on the electron beam path are diverged by the member 51 from the gap g of the output cavity, or from the vicinity of the gap g of the output cavity, namely from the vicinity of the ends of the tubes 37 and 34 as shown in FIG. 7. Accordingly, the magnetic flux density distribution on the beam path is abruptly decreased from the gap or the vicinity of the gap as shown by a solid curve Q in FIG. 7 and is gradually decreased to the vicinity of the hole of the plate 40. It is confirmed according to experiments that the magnetic flux density distribution preferably has characteristics in which the magnetic flux density on the beam path at the intermediate position i between the gap g of the output cavity and the inside position h of the central hole 40***a* of the pole plate 40 is in the range of 60 to 85% of the magnetic flux at the position of the gap g of the output cavity. The magnetic flux density at the position of the hole 40*a* of the inner surface of the plate 40 is less than 50% of the gap position of the output cavity and this value is slightly lower than the conventional klystron having no member 51. As described above, the member 51 is provided to diverge the magnetic flux on the beam path from the gap or the vicinity of the gap of the output cavity and to abruptly decrease the magnetic flux density on the beam path in the vicinity of this position.

Since the tuning frequencies and the Q factor of the resonance cavities and the drift lengths are so selected as to cause the electron beam velocity-modulated by the intermediate cavity at the upstream of the output cavity and further by the cavity at the further upstream side to have large fundamental components immediately before the gap of the output cavity, the input-to-output conversion efficiency of the klystron unit is enhanced. In this case, when the electron beam passes through the output gap and is velocity-modulated, since the electron beam has a large velocity distribution, very slow electrons tend to be produced, however, which are not directed in the reverse direction, or not accelerated to the input cavity. Thus, in general, the electrons of such slow velocity are collected in the tube 37 at the downstream side of the gap of the output cavity. Therefore, the electric potential on the beam path in the tube is lowered, and the electrons of slow velocity fed later are turned back toward the input cavity by the repelling force of the spatial charge in this range, thereby increasing the reverse electron stream. When this reverse electron stream is fed back to the intermediate or input cavity, undesired unstable phenomenon such as the above-described vibration of the output signal, the variation in the output level or an oscillation occurs. On the contrary, the cylindrical magnetic member 51 is provided to diverge the magnetic flux on the beam path from the gap or the vicinity of the gap of the output cavity and to abruptly decrease the magnetic flux density from the gap or the vicinity of the gap in the klystron unit according to the embodiment of the present invention. In this manner, the electrons of slow velocity, after passing through the gap of the output cavity, are forcibly bent radially, thereby directing the electrons to the inner wall surface of the sixth drift tube 37 at this part. Therefore, the decrease in the electric potential in the drift tube can be prevented, and the electrons of slow velocity fed later can be similarly collected by the drift tube, thereby suppressing the production of the reverse electrons returning toward the intermediate and input cavities.

The inventor of the present invention measured the maximum input-to-output conversion efficiency in the range that the klystron unit stably operates by disposing an iron cylinder having 1.5 mm thick, 120 mm bore and 53 mm long as the member 51 so that one end is contacted with the pole plate 40 where the bore (diameter) of the central hole of the plate 40 was 32 cm, the length from the plate 40 to the gap of the output cavity was 100 mm and the minimum bore of the drift tube 37 was 22 mm. As a result, the efficiency of the klystron having no member 51 was approximately 55%, while the efficiency of the klystron having the member 51 has been improved to 63%. In this embodiment, when the length of the member 51 is shortened by approximately a half to 28 mm, the effect was extremely reduced. On the other hand, when the length of the member 51 was largely increased and hence when the length was increased to provide the magnetic flux density distribution to diverge the magnetic flux from for upstream from the gap of the output cavity such as from the vicinity of the interaction gap in the cavity of one cavity upstream of the output cavity, the main electron beam itself is apprehended to be disordered in the focusing. Experimentally, the lines of magnetic force and hence the magnetic flux may be diverged from a point which is disposed at a distance shorter than 3/5 of the distance from the center of the gap g of the output cavity to the center of the gap of the intermediate cavity at the upstream side, preferably 1/5 to 2/5 of the distance isolated from the center of the gap g of the output cavity.

The member 51 may be disposed slightly apart from the pole plate 40. In this case, in order to effectively diverge the magnetic flux, it is necessary to lengthen the member 51 a little. If the member 51 is disposed slightly apart from the plate 40, the member 51 is magnetically coupled to the plate 40 through the little space. Accordingly, there is no problem in practical use. It is confirmed by the measurements that the forward electron beam directed from the input cavity side to the collector section is almost collected to the collector section even if this member 51 is disposed. More particularly, the klystron unit was operated and measured in the state that a body current of the electron stream flowing to the drift tube and a collector current of the electron beam collected at the collector section were isolated electrically by the spacer 60 shown in FIG. 4, while the electric potentials of the drift tube and the collector section were the same. In this measurement, when the collector current was 2.1 A, the body current was 10 mA in the case of no member 51, while the body current was slghtly increased to 15 mA in the case of the klystron of the present invention having the member 51. This current of 15 mA is mere 0.7% of the collector current, which is not of sufficient degree for disturbing the main electron beam flow to the collector section. In this manner, the magnetic field distribution of the present invention does not almost affect the adverse influence of the main electron beam flow, but operates on the electrons of slow velocity or reverse electron flow to rapidly collect them to the drift tube.

The present invention provides remarkably advantages by providing a multicavity klystron unit which has two or more intermediate cavities and drift tubes having lengths so disposed that the respective tube lengths, and hence the respective drift gaps (such as the length of the tube 34 between the output cavity and the intermediate cavity at the adjacent upstream side to the output cavity) are shorter than the length of the adjacent on the upstream side or the next tube further on the upstream side. In addition, the present invention provides excellent advantages by the application to the klystron unit which is tuned to a frequency highrer than the central frequency of the operation of the intermediate cavity 33A at the upstream side from the output cavity or at the cavity 31A at the other upstream side from the cavity 33A. Therefore, these intermediate cavities can be tuned to provide the maximum input-to-output conversion efficiency in the original tuning frequency.

Figure 8:
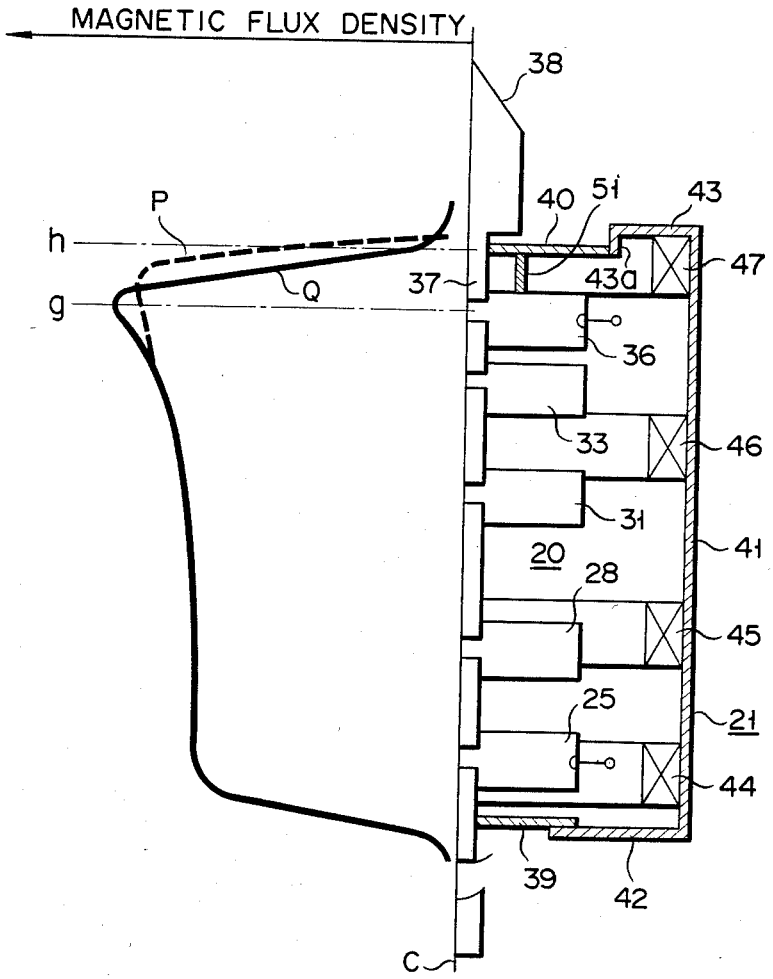
FIG. 8 is a view showing the relationship between the klystron unit according to another embodiment of the present invention and the magnetic flux density therein.

In the klystron unit according to a modified embodiment of the present invention in FIG. 8, an end plate 43 of a yoke 41 is displaced toward the collector section from a pole plate 40 which is fixed to a drift tube 37, and is coupled to a cylindrical member 43*a* of the yoke 41. An electromagnetic coil 47 at the uppermost side in FIG. 8 is arranged intimately with the end plate 43, and a coil 44 of the input cavity side at the lowermost side in FIG. 8 is disposed slightly upward apart from a lower end plate 42. According to this magnetic assembly, when a cylindrical magnetic member 51 is not provided, the magnetic flux density distribution on the electron beam path has the maximum value immediately before the position h on the inner surface of the piece 40 as shown by a curve P of broken line in FIG. 8 and is abruptly decreased from this position. On the other hand, in the klystron unit which has a cylindrical magnetic member 51 provided around the drift tube 37, as shown in FIG. 8, the magnetic flux density distribution has the maximum value in the vicinity of the gap of the output cavity, namely, the vicinity of the end of the tube 37 located at the downstream side of the gap as shown by a curve Q of solid line in FIG. 8, and the magnetic flux density is abruptly decreased from this vicinity, and becomes 60 to 85% of the maximum value in the intermediate range between the positions g and h. This distribution is provided due to the fact that the magnetic field caused by the coil 47 at the output cavity side strongly affects the beam as compared with the other coils on the beam path, and as the density of the beam increases, it serves to prevent the beam diameter from increasing due to the repelling force among the electrons. Part of the magnetic flux on the beam path is diverged from the gap or the vicinity of the gap of the output cavity by the magnetic member 51, thereby preventing the occurrence of returning electrons and thus suppressing the occurrence of the unstable phenomenon.

Figure 1:
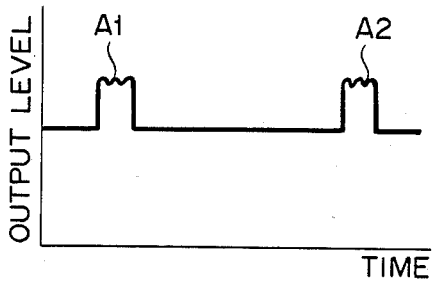
FIGS. 1 and 2 are graphic representations of the relationship between the output waveform from conventional klystron unit and time.
Figure 2:
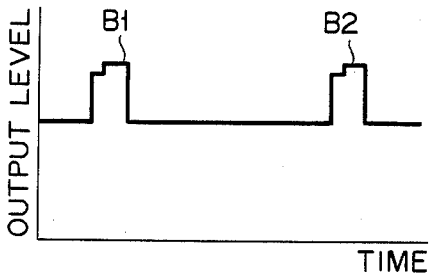

As in the embodiment shown in FIG. 8, when the maximum magnetic flux density point on the axis is disposed at the gap of the output cavity, the occurrence of the unstable phenomenon can be effectively suppressed as described above. On the contrary, the conversion efficiency of the klystron has a tendency to slightly decrease, but no inconvenience occurs in practical use. According to actual measurements, the conversion efficiency is decreased by 2 to 3%. It is presumed that, since the maximum magnetic flux density is provided at the gap of the output cavity, the electron beam at the gap is further focused so that the interaction between the beam and the electromagnetic field at the output cavity is slightly weakened. The inventor of the present invention, then, confirmed that the magnetic flux density distribution on the klystron axis has the maximum value at the point which is slightly displaced to the upstream side from the gap of the output cavity to suppress the occurrence of the unstable phenomenon shown in FIG. 1 or 2 and to simultaneously improve the input-to-output conversion efficiency. The optimum position of the maximum point is, as the result of various experiments, shorter than 3/5, preferably 1/5 to 2/5 of the distance from the center g of the gap of the output cavity to the center of the gap of the intermediate cavity next on the upstream side. In this manner, the vicinity of the gap of the output cavity is again corresponded to the magnetic flux decrease point in the magnetic flux density distribution, and the focusing of the beam is slightly alleviated, so that the beam and field interaction at the output cavity is strengthened, thereby improving the input-to-output conversion efficiency.

Figure 9:
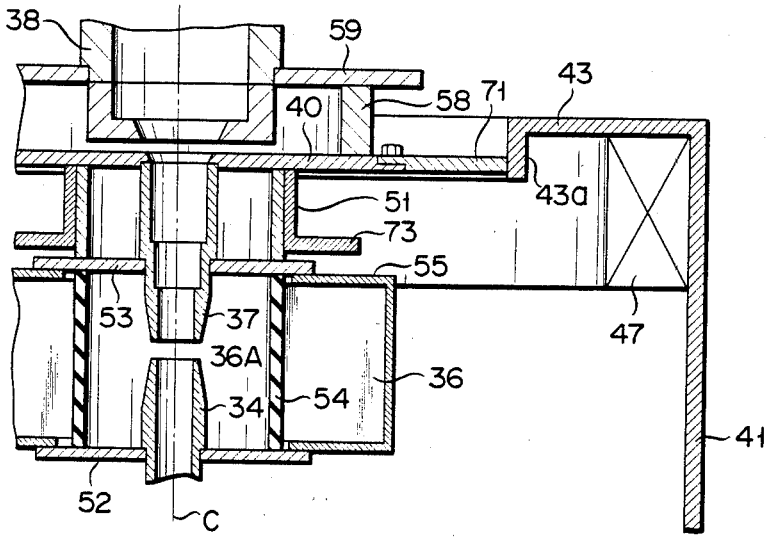
FIG. 9 is a sectional view partly showing the klystron unit according to still another embodiment of the present invention.

In the further modified embodiment shown in FIG. 9, an auxiliary pole plate 71 is magnetically coupled to the outer periphery of the plate 40 provided in the vicinity of the collector section 38, and a magnetic flux diverging member 51 is magnetically coupled to the back surface of the plate 40. The diverging member, namely, the magnetic member 51, is formed of a ferromagnetic material which has a flange 73 expanding at the lower end outwardly. The flange 73 is disposed in the vicinity of the end wall 53 of the output cavity, and is formed in a disk having a size smaller than the outer diameter of the metal box 55.

Figure 10:
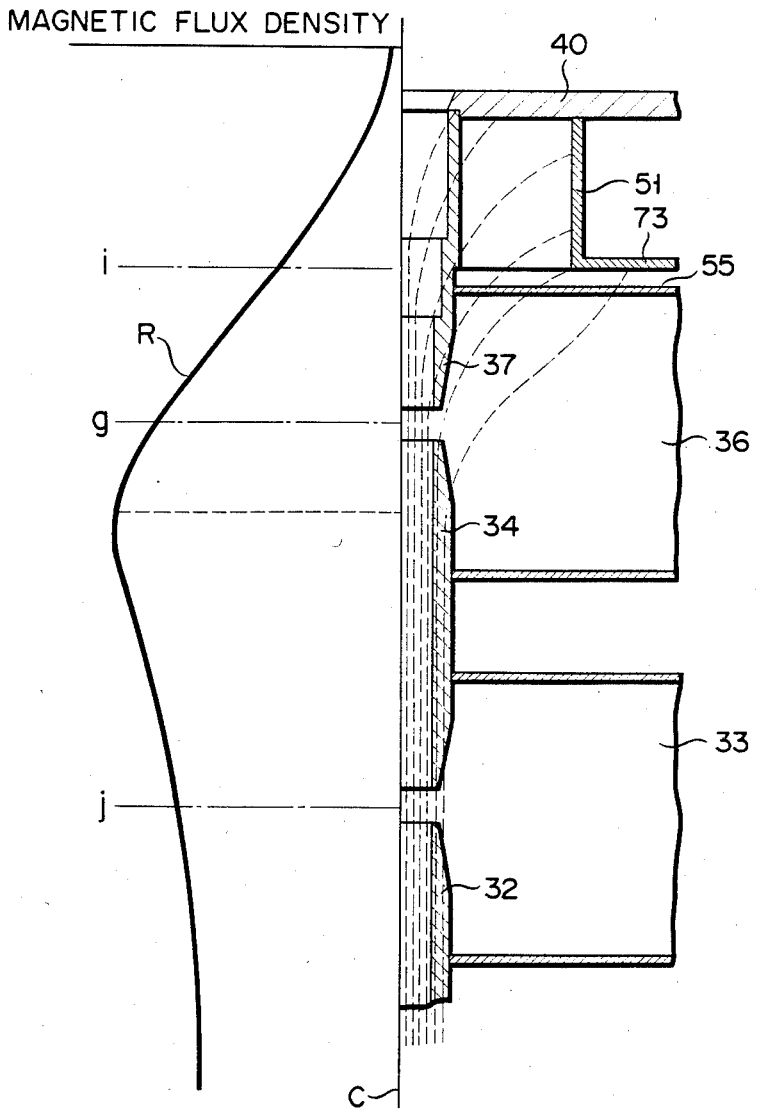
FIG. 10 is a view showing the relationship between the structure of the klystron unit in FIG. 9 and the magnetic flux density therein.

In the klystron unit shown in FIG. 9, the magnetic flux density distribution R shown in FIG. 10 is formed. In other words, the magnetic flux is diverged from the slightly upstream side of the gap of the output cavity. Thus, the returning electrons can be suppressed as described above, and the interaction between the beam and the field at the output cavity can be improved. It is possible to form the magnetic flux distribution shown in R of FIG. 10 without use of the magnetic member having flange 73.

Figure 11A:
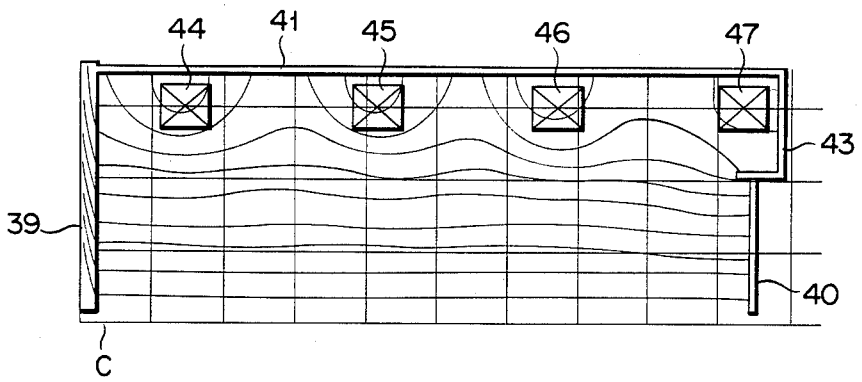
FIGS. 11A, 11B and 11C are views respectively showing the magnetic field distribution in the conventional klystron unit and the klystron units in FIGS. 4 and 9.
Figure 11B:
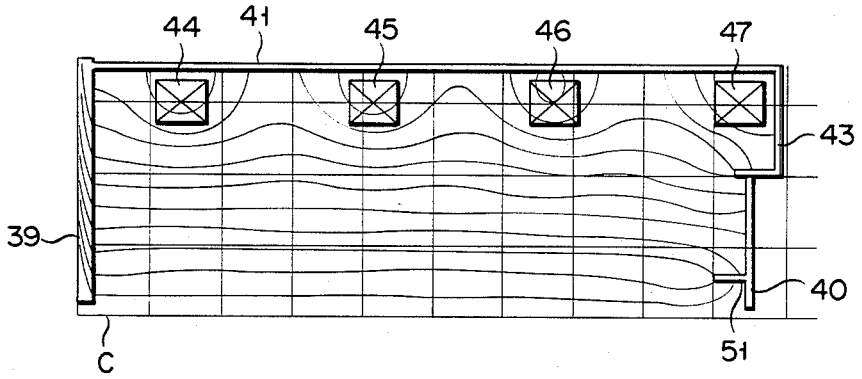
Figure 11C:
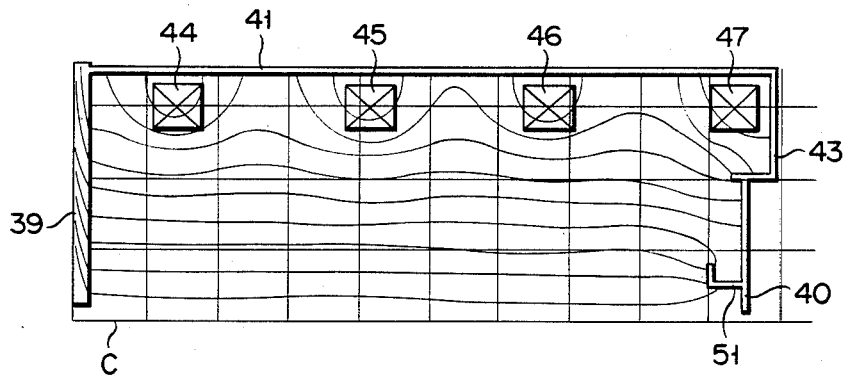

FIGS. 11A, 11B and 11C show the distributions of the lines of magnetic force of the focused magnetic field obtained by a computer simulation analysis. FIG. 11A shows the distribution of the klystron unit which has no diverging member, FIG. 11B shows the distribution of embodiments of the klystron unit in FIGS. 3, 4 and FIGS. 7, 8, and FIG. 11C shows the distribution of the embodiments of the klystron unit in FIGS. 9 and 10. From these Figures, the differences of the distribution of the lines of magnetic force in the vicinity of the output cavity varying by the member 51 can be readily understood. In FIGS. 11A, 11B and 11C, all the klystron units had the same shape and size except whether the magnetic member 51 is provided or not.

Figure 12:
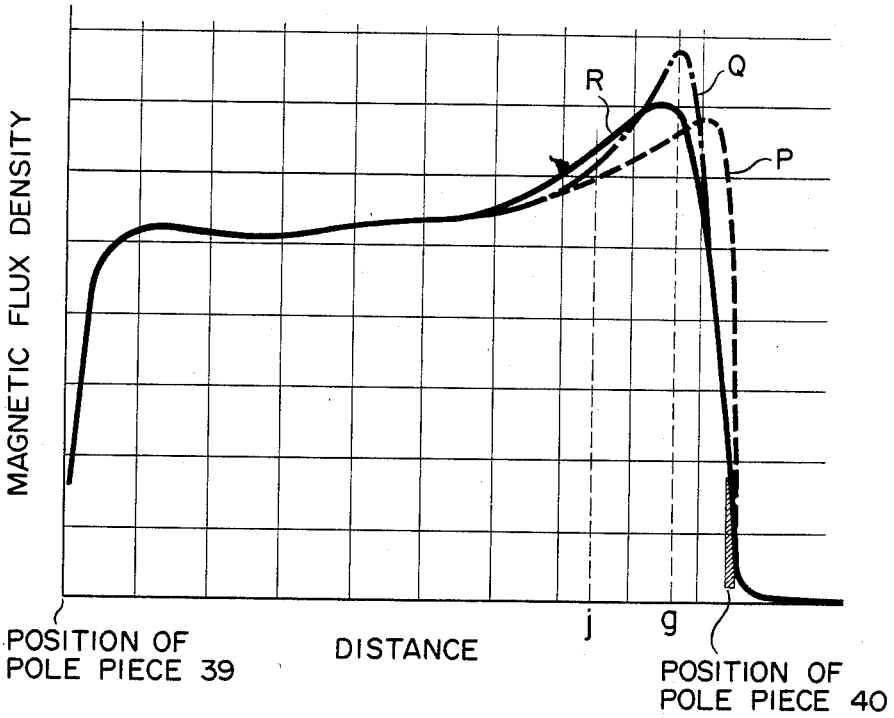
FIG. 12 is a graphical representation showing the magnetic flux density distributions on the tube axis in comparison between the conventional klystron unit and the klystrons in FIGS. 4 and 9.

FIG. 12 shows the magnetic flux density distribution on the tube axis C and hence on the beam path. A curve P of broken line designates the distribution of the conventional klystron unit having no diverging member 50, a curve Q of one-dotted chain line shows the distribution of the embodiments in FIG. 8, and a curve R of solid line shows the distribution of the case of the embodiment in FIG. 9. Symbol j indicates the central position of the gap of the intermediate cavity 33A at the upstream side of the output cavity.

Figure 13:
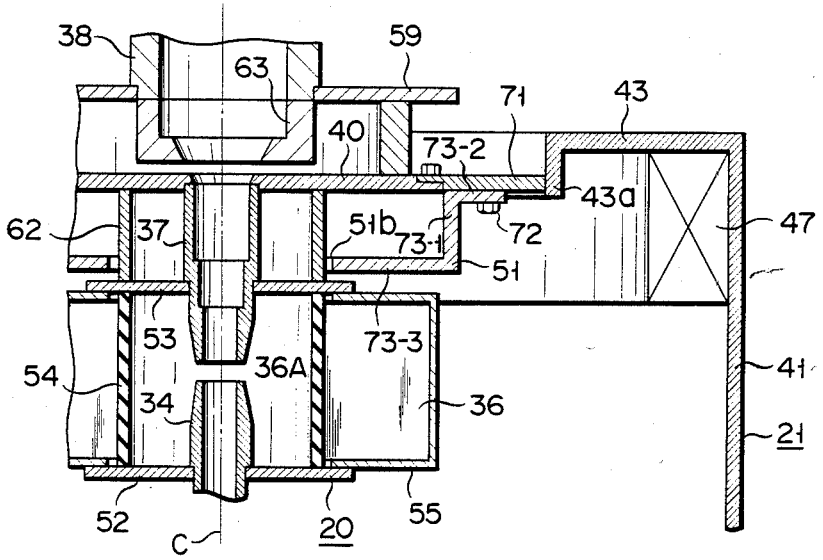
FIGS. 13 to 17 are sectional views respectively partly showing the klystron unit according to still another embodiments of the present invention.

The embodiments of the klystron unit of the present invention in FIGS. 13 to 17 show modified examples of the diverging member 51. In FIG. 13, the diverging member 51 of ferromagnetic material has a cylindrical section 73-1, a flange 73-2 and a flange 73-3. The flange 73-1 is fixed by screws 72 to the inner surface of an auxiliary pole plate 71 which is magnetically coupled to a pole plate 40 provided in the vicinity of a collector section 38. The flange 73-3 is extended parallel to the plate 40 and inward of the cylindrical section 73-1 and the opening end 51b is located around a reinforcing cylinder 62. In this embodiment, part of the magnetic flux is diverged by the magnetic member 51 from the vicinity of the gap of the output cavity or from the cavity on the upstream side of the output cavity.

Figure 14:
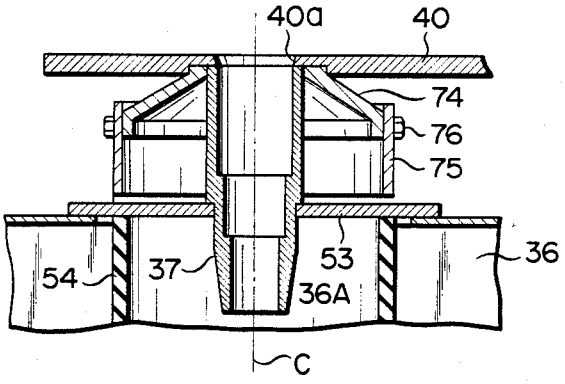

In the embodiment of the klystron unit shown in FIG. 14, one end of a magnetic flux diverging member 51 is formed in a small diameter and is coupled to the outer periphery of the hole 40*a* of the pole piece 40. The magnetic member 51 has a tapered section 74 which is expanded outwardly and the cylindrical section 75 of large diameter is fixed by screws 76 to the cylindrical section 75, which is extended toward the output cavity 36A along a drift tube 37. This section 75 has slits, to which the screws 76 are inserted, and is engaged movably via a screws 76 so as to be adjusted at the position relative to the gap of the output cavity. The magnetic flux on the beam path can be finely adjusted by shifting the section 75.

Figure 15:
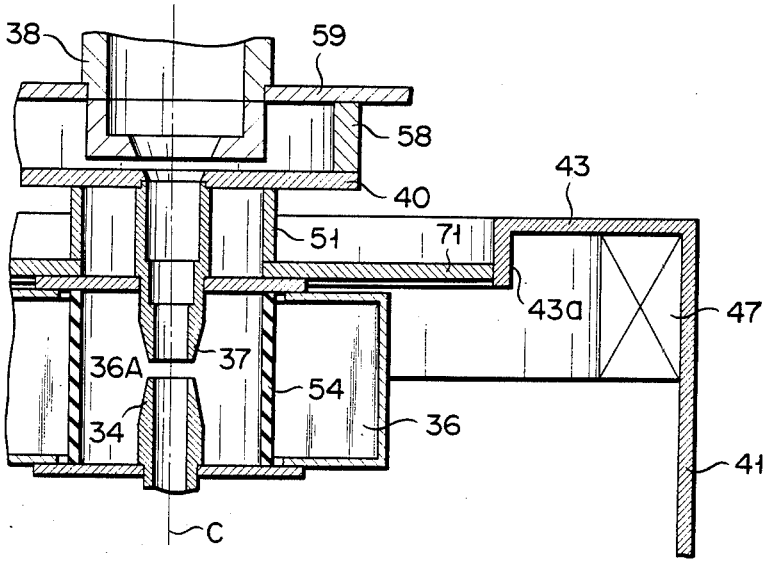

In the embodiment shown in FIG. 15, an electromagnetic coil 47 of the collector side is partly faced to the resonator 36, an auxiliary pole plate 71 is provided inside the cylindrical section 43*a* of the yoke end 43, which is coupled to the lower end of the magnetic member 51. A pole plate 40 coupled to the upper end of the cylindrical magnetic member 51 is arranged in the vicinity of the collector section 38 and is coupled to the drift tube 37. In this embodiment, the magnetic diverging member 51 is formed of the pole plate 71 and the magnetic member, which form part of the pole pieces of the magnetic coil assembly. Thus, the maximum point of the magnetic flux density distribution on the klystron axis is disposed at the output cavity gap or slightly at the upstream side of the gap, from which the distribution can be abruptly decreased toward the collector section.

In the embodiment described above, the cylindrical magnetic member is provided outside the drift tube. However, the present invention is not limited only to this. For example, the reinforcing cylindrical member 62 itself shown in FIG. 4 is formed of a ferromagnetic material such as iron, thereby operating as the cylindrical magnetic member. Since the cylindrical magnetic member 51 shown in FIG. 4 may not be additionally attached in this case, the structure does not become undesirably complicated but becomes simple.

Similarly, part or all of the end wall 53 of the output cavity may be formed of a ferromagnetic material in FIG. 4. In this case, the end wall 53 of the output cavity formed of the ferromagnetic material is magnetically connected through a relatively large space from the pole plate 40, and part of the magnetic flux on the electron beam path starts diverging outside in the vicinity of the output cavity gap or slightly on the upstream side of the gap. In this case, the member 51 in FIG. 4 may be used. When the length of the member 51 is suitably selected, the magnetic field distribution of the present invention can be suitably adjusted.

Further, part or all of the radiator fins 57 fixed to the other periphery of the tube 37 shown in FIG. 4 may be formed of a ferromagnetic material, and the magnetic member 51 may be omitted.

Figure 16:
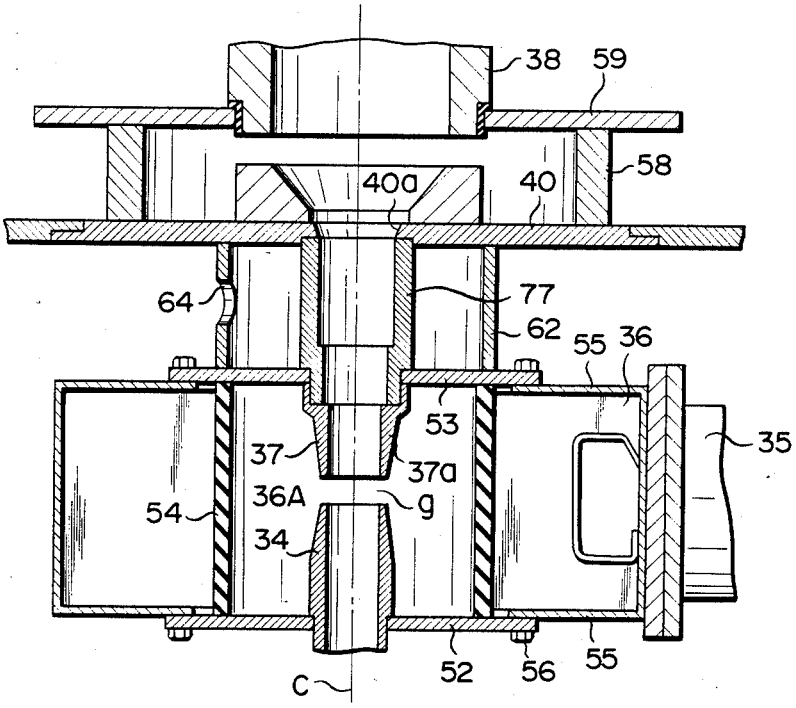

In the embodiment of the klystron unit shown in FIG. 16, part of a drift tube 37 is formed of a ferromagnetic cylinder 77. A copper drift tube cap 37*a* projected into the output cavity 36A is fitted to the cylinder 71. According to this embodiment, the magnetic flux is diverged from the downstream side of the gap of the output cavity.

Figure 17:
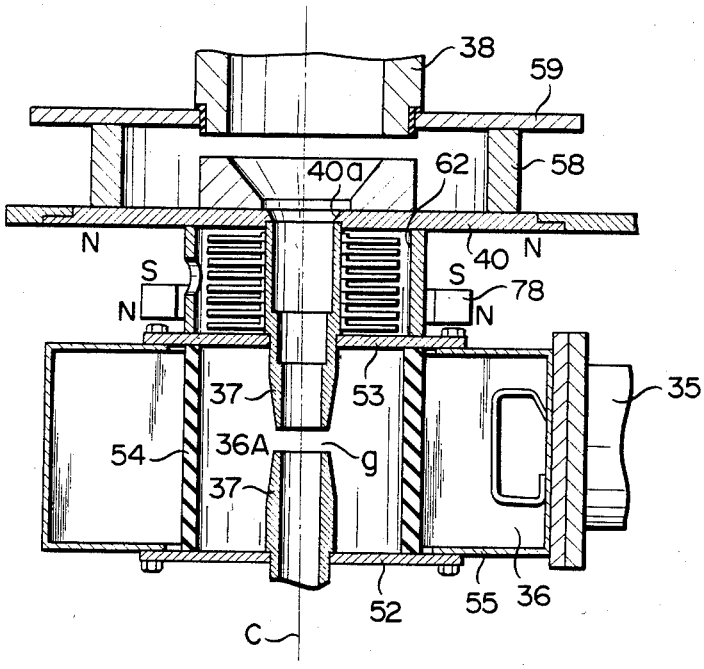

In the embodiment of the klystron unit shown in FIG. 17, a ring-shaped permanent magnet 78 is disposed at the outside of a drift tube 37. In this case, as shown in FIG. 17, when an upper pole plate 40 is N-pole, the upside of the permanent magnet 78 is magnetized to be S-pole, and the downside is N-pole. The magnet 78 is magnetically coupled to the pole plate 40, and the part of the focusing magnetic flux on the beam path is directed toward the outside in the vicinity of the gap of the output cavity or slightly on the upstream side of the output cavity, and the magnetic flux density on the beam path can be abruptly decreased in the distribution. The magnet 78 may be an electromagnet thereby forming the diverging member 51.

In the embodiments described above, a cylindrical magnet or ferromagnetic material is coaxially provided at the outer periphery of the drift tube. However, the present invention is not limited to this arrangement. For example, an arbitrary shape such as a bar-shaped, semicircular shape or U-shape of magnets or ferromagnetic pieces may be provided symmetrically to the beam path or asymmetrically disposed in the vicinity of the periphery of the beam path.

Further, the present invention may also be applied to a collector potential decrease type klystron unit.

According to the present invention as described above, the klystron unit can be provided with high efficiency and stable operation characteristics with a relatively simple structure.

What is claimed is:

1. A klystron unit comprising:

electron gun means for generating an electron beam along a beam path;

collector means for collecting said electron beam;

input resonator means located along said beam path in the vicinity of said gun, for defining an input resonance cavity and velocity-modulating said electron beam in response to an input signal;

output resonator means for defining an output resonance cavity located along said beam path in the vicinity of said collector means, from which an output signal is picked up;

at least one intermediate resonator means disposed along said electron beam path between said input and output resonator means, for defining at least one intermediate resonance cavity for velocity-modulating said electron beam;

drift tubes disposed along said electron beam path, for coupling said resonators to each other and defining a drift gap in each resonance cavity;

means for generating a magnetic flux along said electron beam path to focus said electron beam; and means for providing magnetic flux density distribution along said electron beam path to cause a maximum point of said distribution to fall within a predetermined area, and to cause said magnetic flux density to decrease from said maximum point to said collector means, said predetermined area being between said drift gap in said output resonance cavity and a point at most 3/5ths of the distance from said output resonance cavity drift gap to the drift gap of an intermediate resonance cavity which is adjacent to said output resonance cavity.

2. A klystron unit according to claim 1, wherein said means for providing magnetic flux density distribution includes a magnetic member providing on an outer periphery of a drift tube which couples said output resonator means to said collected means.

3. A klystron unit according to claim 1, wherein said predetermined area is between 2/5ths to 1/5ths of said distance.

4. A klystron unit according to claim 1, wherein said means for generating includes magnetic coils, a yoke, and a pole piece secured to a drift tube provided between said collector means and said output resonator means and coupled magnetically to said yoke.

5. A klystron unit according to claim 4, wherein the magnetic flux density in a drift position between an interaction space within said output resonator means and said pole piece is set to substantially 60 to 85% of the magnetic flux density in the drift gap within said output resonator means.

6. A klystron unit according to claim 1, wherein said drift tubes have different lengths from each other.

7. A klystron unit according to claim 1, wherein said means for providing said magnetic flux density distribution includes a magnet provided at an outer periphery of a drift tube coupling said output resonator means to said collector means.

8. A klystron unit according to claim 4, wherein said means for providing magnetic flux density distribution includes a magnetic member magnetically coupled to said pole piece.

9. A klystron unit according to claim 8, wherein said magnetic member has a cylindrical shape.

10. A klystron unit according to claim 1, wherein said means for providing magnetic flux density distribution includes a part formed of a ferromagnetic member of the drift tube coupling said output resonator means to said collector means.

11. A klystron unit according to claim 1, wherein at least one of said intermediate resonance cavities defined by one of said intermediate resonators has a tuning frequency higher than a central frequency of said unit.

12. A klystron unit comprising:

an electron gun for generating an electron beam having a path;

a collector section for collecting said electron beam generated from said gun;

an input resonator disposed along said path in the vicinity of said gun, for defining an input resonance cavity and velocity-modulating said electron beam in response to an input signal;

an output resonator for defining an output resonance cavity disposed along said path in the vicinity of said collector section, from which an output signal is picked up;

at least one intermediate resonator disposed along said electron beam path between said input and output resonators for defining at least one intermediate resonance cavity for velocity-modulating said electron beam;

drift tubes disposed along said electron beam path for coupling the resonators to each other and defining a drift gap in each resonance cavity;

means for focusing said electron beam by forming a magnetic field along said electron beam path; and means for providing magnetic flux density distribution along said electron beam path to cause a maximum point of said distribution to fall within a predetermined area, and to cause said magnetic flux density to decrease from said maximum point to said collector section, said predetermined area being between said drift gap in said output resonance cavity and a point at most 3/5ths of the distance from said output resonance cavity drift gap to the drift gap of an intermediate resonance cavity which is adjacent said output resonance cavity.

13. A klystron unit according to claim 12, wherein said means for providing magnetic flux density distribution includes a magnetic member provided on an outer periphery of a drift tube coupling said output resonator to said collector section.

14. A klystron unit according to claim 12, wherein said means for focusing said electron beam includes magnetic coils, a yoke, and a pole piece secured to a drift tube provided between said collector section and said output resonator and coupled magnetically to said yoke.

15. A klystron unit according to claim 14, wherein the magnetic flux density in an intermediate position between the drift gap within said output resonator and said pole piece is set to substantially 60 to 85% of the magnetic flux density in the drift space within said output resonator.

16. A klystron unit according to claim 12, wherein said drift tubes have different lengths from each other.

17. A klystron unit according to claim 12, wherein said means for providing magnetic flux density distribution includes a magnet provided at an outer periphery of a drift tube coupling said output resonator to said collector section.

18. A klystron unit according to claim 14, wherein said means for providing magnetic flux density distribution includes a magnetic member magnetically coupled to said pole piece.

19. A klystron unit according to claim 18, wherein said magnetic member has a cylindrical shape.

20. A klystron unit according to claim 12, wherein said means for providing magnetic flux density distribution includes a part formed of a ferromagnetic member of the drift tube coupling said output resonator to said collector section.

21. A klystron unit according to claim 12, wherein at least one of said intermediate resonance cavities defined by at least one of said intermediate resonators has a tuning frequency of higher than a central frequency of said unit.

* * * * *